United States Patent [19]

King

[11] Patent Number: 4,549,400

[45] Date of Patent: Oct. 29, 1985

[54] ELECTRO-HYDRAULIC ENGINE THROTTLE CONTROL

[76] Inventor: Alex C. King, 1160 Kellogg, Green Bay, Wis. 54303

[21] Appl. No.: 599,961

[22] Filed: Apr. 13, 1984

Related U.S. Application Data

[63] Continuation-in-part of Ser. No. 369,446, Apr. 19, 1982, abandoned.

[51] Int. Cl.[4] ..... F15B 21/10

[52] U.S. Cl. ..... 60/394; 60/431; 417/12; 417/34; 417/25

[58] Field of Search ..... 417/12, 34, 44, 45, 417/46, 47; 60/431, 433, 452, 420, 394, 906, 911

[56] References Cited

U.S. PATENT DOCUMENTS

| | | | |
|---|---|---|---|
| 2,643,515 | 6/1953 | Harsch | 60/911 |
| 2,646,205 | 7/1953 | Rosenschold | 417/12 |
| 3,111,903 | 11/1963 | Waterman | 417/34 |
| 3,159,965 | 12/1964 | Woolley et al. | 417/34 |
| 4,180,374 | 12/1979 | Bristow | 417/12 |
| 4,330,238 | 5/1982 | Hoffman | 417/34 |

*Primary Examiner*—Edward K. Look

*Attorney, Agent, or Firm*—Fuller, House & Hohenfeldt

[57] ABSTRACT

An electroresponsive device is energized to actuate an internal combustion engine throttle for switching the engine from idle to a higher speed. The engine drives a hydraulic pump that supplies fluid through a control valve, then a cylinder lock, for driving hydraulic work cylinders. A first switch responds to a low pressure level being exceeded, due to fluid being directed by the control valve to an actuator, to increase engine speed, thereby making the pump pressure higher. A second switch responds to the higher pressure to continue the increased engine speed. When the control valve is restored to neutral position, the hydraulic fluid bypasses through the control valve directly to a sump and the second switch responds to the lower pressure by allowing the engine to go idle speed. A time delay device is provided for disabling the first switch during the time that pressure is dropping from the higher level to below the lower level.

14 Claims, 3 Drawing Figures

ELECTRO-HYDRAULIC ENGINE THROTTLE CONTROL

This is a continuation-in-part of pending application, Ser. No. 369,446, filed April 19, 1982 now abandoned.

BACKGROUND OF THE INVENTION

This invention relates to apparatus for controlling the speed of an internal combustion engine on a truck, for example, when the engine is being used to drive a pump that supplies high pressure hydraulic fluid for operating hydraulic work cylinders, motors or other actuators for mechanisms on the truck.

The new speed control is especially useful for aerial bucket trucks that are sometimes called cherry pickers. Such trucks are typically provided with articulated booms, or an extending stinger or stingers that support a bucket or buckets in which a person or persons stand while working on street lights, telephone and electric lines and doing painting work, for example. Typically, hydraulic actuators such as work cylinders are used to drive the components of the boom assembly in and out, up and down and left and right in proximity with the work. Comfort, convenience and safety of the worker requires that he be able to position the bucket precisely with respect to the work and to obtain an immediate movement response when one or more controls that are mounted in the bucket or in the area of the bucket are operated in contemplation of moving or repositioning the bucket.

The internal combustion engine that propels the truck is used for driving a pump that provides the hydraulic pressure for extending and contracting the work cylinders which act on the boom sections to move the bucket. In providing this hydraulic power, it is desirable to have the engine running at the lowest recommended idle speed and for the pump to be producing minimum volume and pressure until the operator uses a control to effect a bucket shift in one direction or another. Then, to provide fast response of the hydraulic mechanism, it is desirable to have the engine speed rise from idle speed to a predetermined maximum as rapidly as possible so there will be a corresponding rapid increase in pump volume and pressure.

A common problem in prior art throttle control systems is the delay that occurs between the time the operator manipulates a control valve handle and the time adequate pressure builds up to cause the bucket movement. This makes it difficult for the operator to jog or feather the bucket movement into the desired location and causes undesirable anticipation by the operator of bucket movement following control valve actuation. The lack of positive and fast response also decreases operational efficiency and safety and increases engine fuel consumption.

Various types of hydraulic throttle controls for pump driving engines are in use. Typically, there is a conduit leading from the output of the pump to one or more series or parallel connected work cylinder control valves which allow the hydraulic fluid from the pump to return to a sump when a control valve is not actuated. Low pump output pressure exists in the conduit at this time and the throttle on the driving engine senses this low pressure and causes the engine to run at idle speed. When a valve is actuated to operate a work cylinder, the return flow to the sump is cut off, and the pressure rises at the output of the pump. A desirable feature of any system would be to have the throttle control sense the increase in pressure and immediately switch the engine to run at a higher speed to thereby increase pump output and cause immediate movement of the work cylinders. Typically, in prior art controls, pressure in the conduit leading from the pump output to the control valve is sensed with a cylinder and piston arrangement. The cylinder has an input from the pump output conduit. The piston is moved in one direction or another in response to increases and decreases in pressure. The piston works against a spring and is connected by way of suitable linkage to the engine carburetor throttle. A pressure increase in the pump output conduit, due to the fluid return being stopped by actuation of a control valve, moves the piston in a direction to open the throttle and increase engine speed. A pressure decrease in the conduit causes the piston to move in a direction that causes the throttle to return the engine to idle speed. A disadvantage of this system is that it takes time to drive the pressure sensing piston to the end of its travel to obtain the higher engine speed. In prior art systems there is as much as a ten second lag before the engine reaches proper speed to cause the pump to build up maximum hydraulic pressure. In order to improve the response rate, the engine idle speed adjustments are customarily set high or fast. This tends to reduce the differential between idle speed pressure and work cylinder operating pressure. Typically, the engine might have to operate at an idle speed of 700 or 800 rpm compared to a normal lower and more desirable idle speed of 550–600 rpm, for example. However, the higher idle speed does not reduce the delay to a desired minimum. The higher idle speed results in increased engine fuel consumption and maintenance. High idle speed also increases ambient noise levels, an undesirabe factor when oral communication between personnel is necessary.

Also, in the operation of a boom truck with hydraulic devices, the hydraulic system is called on to actuate the devices only a small fraction of the working time. In other words, the driving engine is in the idle mode most of the time. This factor accentuates the undesirability of high idle speeds.

In prior art throttle control systems which use a hydraulic piston for regulation of engine speed there is also a substantial delay before the engine returns to idle speed after the hydraulic actuator control is returned to the neutral position. In part, a reason for this is that even though return of the pump output to the sump is being allowed, there is always some back pressure in the system, due to fluid friction encountered in tubing, hoses, fittings, and system filter or filters. The system back pressure also varies greatly due to temperature changes which change the viscosity of the hydraulic oil. Higher viscosity associated with lower temperatures results in a delay in the fall-off of the system pressure, prolonging the higher engine speed interval and contributing to increased fuel consumption and maintenance.

A hydraulic pressure switch and an electroresponsive means has been tried and used but has most of the problems mentioned above because a pressure switch has an inherent differential, that is, the pressure required to close its contacts is higher than the pressure required to open its contacts.

SUMMARY OF THE INVENTION

An object of the invention is to provide a throttle control which, when work fluid is demanded, switches the pump driving engine without delay from idle speed to a higher predetermined speed at which the pump puts out full pressure and volume for driving a hydraulic actuator such as a fluid motor or a work cylinder.

A further object is to provide a control system that permits the engine driven pump to run at minimum idle speed to achieve the goals of minimizing fuel consumption and engine wear and of increasing operator productivity.

A further object is to provide an engine throttle control that will remain stable and accurate and will require a minimum of attention or adjustment over a long period of time, and can also be utilized on other types of hydraulic systems such as multi-pump systems and various types and designs of hydraulic valves or valve sections and work cylinders with pressure lock valves.

Briefly stated, in accordance with one embodiment of the invention, the engine throttle is set for low idle speed and a higher predetermined speed with an electro-responsive actuator such as an electric solenoid. First and second pressure responsive switch means are used to sense the pressure between the output of the pump that is driven by the engine and the input to the manually operable control valves. The first pressure switch means is set to close its switch when there is a slight increase in pressure, due to a control valve being opened to open the pressure lock valve, and provide fluid pressure to a work cylinder. Closing of the first pressure switch energizes a time delay device to initiate a timing interval. During this interval, a relay that is controlled by the device maintains its contact closed for energizing a higher capacity relay that, in turn, energizes the electric solenoid connected to the engine throttle to thereby pull the throttle open without delay. The resulting higher engine speed and correspondingly higher hydraulic pressure and flow that is obtained immediately causes the second or high pressure responsive switch means to close its contact, and after a few seconds of operation in this mode, the time delay relay contact opens. This removes the low pressure switch from the circuit until the system pressure again drops below the low pressure switch setting. The high pressure switch remains closed and this, in turn, maintains energization of the high capacity relay and the throttle setting electric solenoid which continues to hold the engine throttle open to its preset increased rpm. When the bucket operator returns all hydraulic actuator controls to neutral position, the pump output is returned to the sump again, the pressure in the conduit drops below the high pressure switch setting, opening the circuit to the high capacity relay and to the solenoid so the engine goes immediately to idle rpm. The hydraulic pressure continues to drop until it is below the low pressure switch setting and the low pressure switch then opens to de-energize the time delay device and its low powered relay. This is one complete cycle and the throttle control is now available to repeat the above cycle.

By way of example and not limitation, the first pressure responsive switch means may be set to close its switch at or about 300 psi which develops at engine idle speed if a control valve is actuated. The time delay device typically is adjusted to open its contacts at three to five seconds after being energized. The second pressure responsive switch means is adjusted to close its switch at some higher pressure than the first one such as at 700 psi. The normal operating pressure is then obtained in the operating mode by properly setting the engine rpm which is typically set in a range of 1200 to 1700 rpm. This speed will provide the proper hydraulic pressures and pump output gallons per minute to properly operate the booms and bucket as required by the bucket operator.

Also incorporated in the throttle control circuitry is a double-pole double-throw toggle switch which can be installed remotely or incorporated in the throttle control box. This switch has three positions: (1) in center position it is "off" which completely removes the electric power from the electro-hydraulic engine throttle control; (2) in one active switch position, the electro-hydraulic engine throttle control is turned on for automatic engine speed control as desired by the bucket operator; and (3) in another active position, the engine speed will be maintained at a steady increased rpm (usually in the range of 1200 to 1700 rpm). This will enable the ground crew to use the hydraulic system on a continuous basis (when no one is using the bucket) for such apparatus as hydraulic tools which include drills, tree saws, pruners, ground tampers, water pumps, generators and impact wrenches. This increased engine speed is performed by the toggle switch energizing the pull-in coil of the high powered relay which energizes the solenoid.

In an alternate embodiment of the invention, a single pressure-to-analog signal transducer is used instead of the two pressure responsive switches as in the embodiment just described. The transducer produces a signal whose magnitude is proportional to pressure and this signal is amplified and is supplied to two different amplifiers. The first amplifier turns on in response to a pressure increase resulting from actuating a control valve. This causes the engine to switch from idle to higher speed. The second amplifier turns on in response to the higher pressure that quickly develops and it maintains the higher engine speed as long as the control valve is actuated. When the control valve is turned off, the second amplifier turns off and the engine drops to idle speed. When the first amplifier turns on, it charges a capacitor in an RC timing circuit which blocks the amplifier output until a delay interval elapses following the pressure drop elapses. Thus, when the second amplifier turns off due to the drop from the highest pressure that results from high engine speed, the first amplifier remains blocked so the pressure can descend to below the low threshold pressure without maintaining energization of the relays that switch the engine to high speed.

The manner in which the foregoing and other more specific objects of the invention are achieved will become evident in the ensuing more detailed description of a preferred embodiment of the invention which will now be set forth in reference to the drawing.

DESCRIPTION OF A PREFERRED EMBODIMENT

Figures 1, 2:
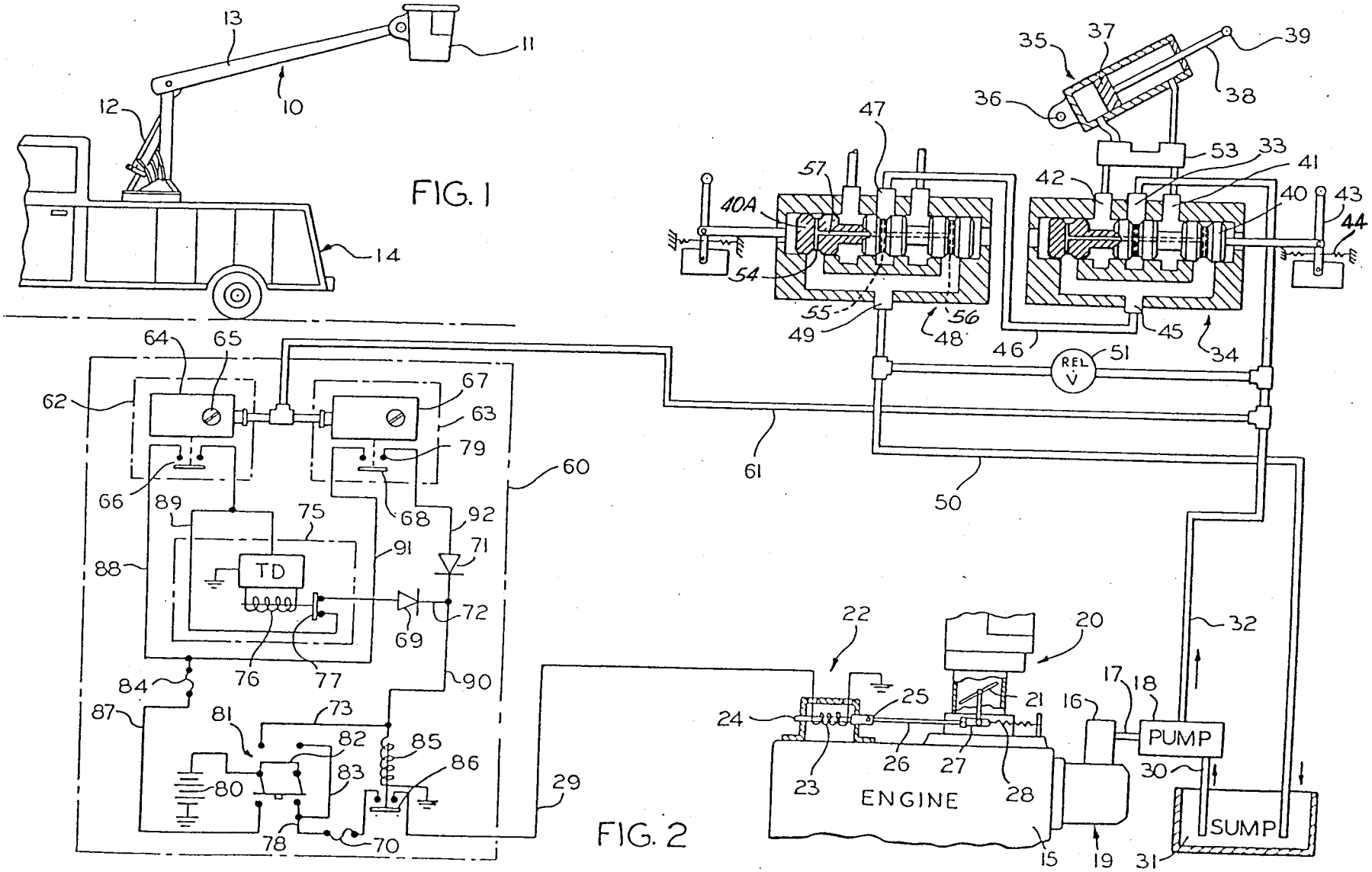
FIG. 1 is a diagram of a truck on which an aerial bucket and its articulated support booms are mounted for being controlled by the new electrohydraulic engine throttle control.
FIG. 2 is a schematic representation of a hydraulic system that incorporates the new engine throttle control.

FIG. 1 illustrates one use of the new control system where an articulated boom assembly 10 supports a bucket 11 in which a person stands to perform aerial work. One of the hydraulic actuators such as the one that would be used to change the angle of the boom section 13 and the height of the bucket is identified by the numeral 12. It will be understood that there would be other hydraulic actuators such as work cylinders or fluid motors for manipulating the boom in other ways such as to move the bucket left and right or in and out relative to the truck 14 on which the boom is supported. By way of example, the truck may be one of a type that is commonly used by an electric utility for performing aerial work. It will be understood that such trucks have a power take-off from the engine or other sources of power from the engine such as a transmission-mounted power take-off or a belt drive for driving a hydraulic pump that supplies fluid to the actuators for the boom.

Referring now to FIG. 2, the internal combustion engine for driving the truck is shown fragmentarily and is marked 15. It has a transmission 19 driving a power take-off 16 whose output shaft 17 is coupled to a hydraulic pump 18 for driving the latter. Typically, there would be a clutch, not shown, for engaging the pump in driving relation with the engine.

The engine carburetor is shown fragmentarily and marked 20. It has the customary throttle plate 21 which is variously angulated to change engine speed. The term "throttle" is used herein to indicate any engine speed control. For instance, if the engine were one that used fuel-injection instead of a carburetor, a regulating valve might be used as a throttle.

In accordance with the invention, throttle position, and idle speed and an alternative higher speed for the engine are obtained by controlling the throttle with an electro-responsive device in the form of a high-power electric solenoid 22 which has an operating coil 23 and a magnetically attractable armature 24. The armature is linked with a clevis 25 to a rod 26, which could be a cable or chain, which connects to the throttle linkage 27. A spring 28 is for returning the throttle to engine idle position when the solenoid coil 23 is de-energized. The electric power supply line to the solenoid coil 23 is marked 29.

Hydraulic pump 18 draws fluid by way of an input pipe 30 from a fluid reservoir or sump 31. The pump output conduct 32 connects to the pressurized input port 33 of one of the manually operable control valves 34 which would be mounted in the bucket 11 along with some similar valves. The valve 34 is diagrammed in accordance with convention for open-centered valves. A hydraulic actuator is represented by a two-way hydraulic work cylinder 35. The work cylinder would be anchored at one end 36. The cylinder is provided with a piston 37 and a piston rod 38 that would connect at 39 to one of the boom sections, for instance, for angulating or otherwise moving it in response to axial movements of piston 37.

Control valve 34 has an internal spool 40 which when shifted to the left connects the input port 33 to one of the output ports 41 through which fluid is supplied to one side of piston 37. Shifting spool 40 to the right causes input port 33 to be coupled to output port 42 through which pressurized fluid from the pump is supplied to the other side of piston 37. The spool is shifted with an operator's handle 43 which, when released allows the spool to return to the neutral or center position in which it is shown for cutting off fluid flow through either of the output ports 41 or 42. The spool is returned to center when the handle is released under the influence of a pair of centering springs such as the one marked 44.

Valve 34 has an output port 45 which couples by way of a tube 46 to the input port 47 of another control valve 48 which is similar to valve 34. Valve 48 50 has an output port 49 to which a fluid return line is connected. When all control valves such as 34 and 48 are in the neutral position as they are depicted in the drawing, fluid pressure delivered from the pump through output conduit 32 simply flows, as in the case of valve 34, from the input port 33 to the output port 45 and similarly through valve 48 and any other valves that are in the neutral position whereby fluid can return through the return line 50 to sump 31 as typified in valve 48, spool 40A has three diametral holes 54, 55 and 56 which intersect an axial hole 57 that is closed at both ends. Thus, when spool 40A is in neutral position, as shown, pressurized fluid delivered through valve 34 to input port 47 of valve 48 flows directly back to sump 31 by way of center hole 55, axial hole 57, diametral holes 54 and 56, output port 49 and return line 50 in the stated order. Since the spool 40 of valve 34 is in neutral position, there is presently a comparable return path between its input port 43 and output port 45. A pressure lock valve 53, sometimes called a holding valve, is usually mounted in close proximity to its cylinder and normally on all the cylinders on a bucket or boom truck, where it is desirable to keep a cylinder 35, at a specific depth setting 37 while the cylinder 35 is under a load. Once an operator extends a cylinder 35 to a particular depth using the control valve 34, and then centers the valve 34, the pressure lock valve 53 holds it there permanently until the operator shifts the spool in the control valve 34 to reposition the depth of the cylinder. Pressure load locks are of varying design, but they all perform the same function. In all designs it takes line pressure from the control valve ports 41 or 42 to unload the check valves inside the load lock valve before the piston 35 can be moved in either direction. A non-adjustable, preset, pressure lock valve for locking the oil on both sides of piston 37 is used. If a pressure lock valve is not used, a fixed or adjustable flow restrictor may have to be installed in one of the lines between valve 34 and work cylinder 35.

Prior to this time, it is assumed that the engine has been operating at idle speed to provide minimum pump output pressure. However, it is desirable for the system to respond rapidly to this increase in pressure by switching the engine throttle to its high speed position as quickly as possible so as to make higher pressure available from the pump without any delay being perceived by the operator between the time that the valve is shifted and the hydraulic actuator responds.

The hydraulic system thus far described is basically conventional. It may also contain a relief valve 51 for relieving excess pressure from the pump output conduit 32 to the return line 50 if occasion demands.

The first embodiment of the throttle control will now be described in reference to FIG. 2. Its components, except for the electroresponsive throttle control solenoid 22, are contained within the dashed line rectangle 60. In an actual embodiment, the control assembly 60 is contained within a relatively small box that is mounted on the truck. Throttle control solenoid 22 is preferably mounted on the engine 15.

In FIG. 2, fluid pressure in the pump output conduit 32 is sensed through a tube 61 which connects to the fluid inputs of first and second pressure responsive switch means which are contained within the dashed line rectangles 62 and 63, respectively, and may be incorporated into one housing. The first pressure responsive switch means 62 has a pressure sensor device 64 whose response level can be set with an adjusting screw 65. When the pressure in pump output conduit 32 and sensing tube 61 is below the setting of pressure sensor 64, the switch 66 which is controlled by the sensor is open as it is shown in FIG. 2. At engine idle speed, the pump discharge pressure would be such, for example, to allow the switch 66 to open. Thus, pressure sensor 64 is set to cause switch 66 to open below a low pressure setting and to close when the pressure is above that setting. By way of example and not limitation, in a system such as is under discussion, switch 66 might be set to remain open when the pump output pressure is at or below a low pressure level in a range of 225 to 325 psi such as at 300 psi and to remain closed while the pressure exceeds 300 psi if that is the chosen setting of this pressure responsive switch.

The other pressure responsive switch means 63 is similar in construction except that its pressure sensor 67 is set to cause its switch 68 to close at a higher pressure level than switch means 62 in a range 600 to 700 psi such as at 700 psi, by way of example and not limitation, and to open when the pressure sensed in conduit 32 falls below that pressure.

For the sake of brevity and convenience, low and high pressure settings of 300 and 700 psi, respectively, will be used to illustrate operation of the control system but it should be understood that is for the sake of illustration and that having one pressure setting higher than the other that is most significant.

The control includes a time delay device which is enclosed in the dashed line rectangle 75. The time delay device includes a time delay circuit which is symbolized by the block marked TD. An electronic time delay circuit that uses an RC time constant to control switching transistors (not shown) which in turn, controls a low capacity relay that is a preferred delay circuit since it can be adjusted for measuring short intervals with high precision. However, a thermally responsive time delay device could be used, with or without a low capacity relay. A prefixed time delay period for the time delay circuit is possible, if it were used on a group of trucks that were equipped with the same type of hydraulic system, engine, and power take-off.

The two diodes 69 and 71 are used in the circuitry. Diode 71 is installed between line 90 and 92 which connects the pressure responsive means 63 to a switching device in the form of a high power relay 85. Diode 69 is installed in line 72 which connects the time delay device 75 to the line 90 and then to the high powered relay 85. When the toggle switch 81 is in its "up" position to energize the high powered relay 85 and the electroresponsive throttle means directly by way of line 73, diode 69 prevents feedback to the time delay relay 75. Diode 71 prevents feedback to the pressure responsive switch 68. The time delay circuit controls a relay coil 76 which operates a low power normally closed lockout relay switch contact 77. The time delay circuit is energized through line 89 from switch 66 in the low pressure responsive switch means 62. The manner in which the time delay device 75 is used will be described shortly hereinafter.

The control circuit is energized from a dc source which may be the battery 80 that is on board the truck 14. The positive terminal of the battery 80 connects to a two-pole double-throw switch 81. This switch may be mounted in the control box unit, or mounted remotely from the control as requested by the truck owner when the control unit is installed. Switch 81 has a jumper 82 which connects both of its blades in common to the dc source 80. When switch 81 is in its down position as shown, current from the source 80 feeds through line 87, fuse 84, switches 66 and 68 if closed, the time delay device 75, the high capacity relay coil 85, and the diodes 69 and 71, and fuse 70, high capacity relay contact 86, line 29, and the solenoid coil 23. When the switch 81 is in its down position, the electro-hydraulic throttle control is turned on for automatic engine speed control as desired by the bucket operator.

Automatic engine speed control can be overridden by putting switch 81 in its upper position. Relay coil 85 is then energized by current passing from dc source 80 through line 73 and the coil. Energization of coil 85 causes contact 86 to close. Current then also passes from source 80 through jumpers 83 and 78, fuse 70, contacts 86 and throttle control relay coil 23. Energization of relay coil 23 actuates throttle 21 which causes the engine to run at its higher speed on a steady basis.

When switch 81 is in its center position, it removes all current to 70, 73, 83 and 87, deactivating the electro-hydraulic engine throttle control.

Now that the components of the system have been identified, operation of the control will be described. Assume that the engine is running at idle speed and that the spools in control valves 34 and 48 are centered or in their neutral position so that no fluid is being supplied from pump 18 to any of the hydraulic actuators such as actuator 35. At this time, pressure corresponding to engine and pump idle speed will exist in pump output conduit 32. Switch contacts 66 and 68 of the pressure responsive switch means 62 and 63 will be open.

Now assume that the operator moves control handle 43 of valve 34 to cause fluid to be directed to the hydraulic load lock 53 and to hydraulic actuator 35 to effect movement of some component of the bucket boom. As soon as the control valve is operated, the return line to the sump is blocked off and pressure rises immediately in pump output conduit 32 to above some predetermined low level such as to above 300 psi in this example. In accordance with the invention, as soon as a minor increase above the low pressure setting is sensed by way of sensing line 61, the low pressure responsive sensor 64 in pressure responsive switch means 62 causes switch 66 to close. This completes a series circuit beginning at the output terminal of dc source 80 and extending through jumper 87, fuse 84, line 88, switch 66, line 89, lockout switch contact 77, through a diode 69, line 72, and a line 90 to the high capacity relay coil 85. Energization of the high capacity relay, which occurs immediately, causes its contact 86 to close and connect the high power solenoid throttle actuating coil 23 to the dc source by way of line 29, contacts 36, fuse 70 and jumper 78. The throttle is immediately switched from its idle position to high engine speed position. In accordance with the invention, the engine can run at its lowest tolerable idle speed such as 600 rpm. By way of example and not limitation, the predetermined higher engine speed for handling hydraulic loads on the pump would typically be between 1200 and 1700 rpm. At whatever higher speed is used, assume that the pump will develop a pressure of 650 psi by way of example and not limitation. Because the engine speed increases to the higher predetermined speed almost instantly upon actuation of the throttle, full pressure becomes available at the control valve input port and the operator perceives undelayed movement of the hydraulic actuator 35.

As soon as the circuit just described became energized to energize the high capacity relay 85 so that the pump output pressure increased to the illustrative 650 psi high level if that is the setting, the second pressure switch means responds by closing its switch 68. Then there are alternate paths for current to high capacity relay 85 for a few seconds. This results from the fact that one side of pressure responsive switch 68 is connected by way of a line 91 to the dc power source. Thus, a supply circuit is complete through switch 68 of the second or high pressure responsive means 63, a line 92, diode 71, line 90 and through relay 85. Hence, energization of the relay and the electroresponsive throttle control means 22 are maintained as long as any manually operable control valve is shifted from its center or neutral position.

Assume now that the control valve 34 presently in use is recentered incidental to the operator's desire to terminate boom component movement by actuator 35 without overtravel. With the valve centered, fluid is again bypassed through the control valve and return line 50 to sump 31. The pressure drop in conduit 32 below 650 psi that results from bypassing in this example causes the sensor 67 of pressure responsive switch means 63 to immediately open switch contact 68 to thereby deenergize high capacity relay coil 85 and, of course, the high power throttle actuator relay coil 23. Spring 28 immediately returns the throttle 21 to engine idle position.

Earlier, when switch 66 of the first pressure responsive switch means 62 is closed in response to a higher line pressure above 300 psi being sensed, the time delay circuit (TC) 75 also became energized to initiate a timing interval which, in an actual embodiment, is in the range of 1 to 5 seconds, for example. At the end of this delay interval, contacts 77 of time delay relay 76 opens, and remain open until the pressure has dropped sufficiently for the low pressure sensor 64 to cause switch 66 in the low pressure responsive switch means 62 to open its contacts 66. Immediately, the time delay lockout switch 77 closes its contacts, because the time delay unit 75 is then deenergized. If it were not for the delay period between the opening of contact 68 in the high pressure switch means 63 and the opening of contact 66 in low pressure switch means 62, it would make it an unworkable control system, due to the pressure differential in all pressure switches, as it takes more pressure to energize a pressure switch on pressure rise, and somewhat less pressure to deenergize a pressure switch on a pressure decrease. In other words, the delay interval keeps the circuit open through lockout switch 77 until the pressure in the system, in this illustrative example, drops from 650 psi to 300 psi to bring about opening of switch 66. At this time the complete control system is reset for another actuation of one of the illustrated control valves 34 or 48.

It is to be noted that as soon as high pressure responsive switch 68 is opened, the electroresponsive actuator 22 was deenergized and the engine was switched back to idle speed immediately. The delay which allows switch contact 66 in the first pressure responsive switch means 62 to open, does not delay deceleration of the engine. In prior art systems, that rely exclusively on sensing pump output pressure with a hydraulic piston that actuates the carburetor throttle, a significant amount of time elapses before the throttle switches back to idle speed. This results from back pressure in the hydraulic circuits which resists return by the control piston to its engine idle position. In the present invention, the sensor 67 in pressure sensitive switch 63 is set so that as quickly as pressure in sensing tube 61 drops below its set point of 650 psi in this example, switch 68 opens to deactivate electroresponsive throttle control 22. Thus, the system may be characterized as being one that brings about high pressure hydraulic fluid supply to an actuator with a snap action and that kills the pressure with a snap action even though there is a short delay imposed while the pump pressure is settling to its idling level.

Figure 3:
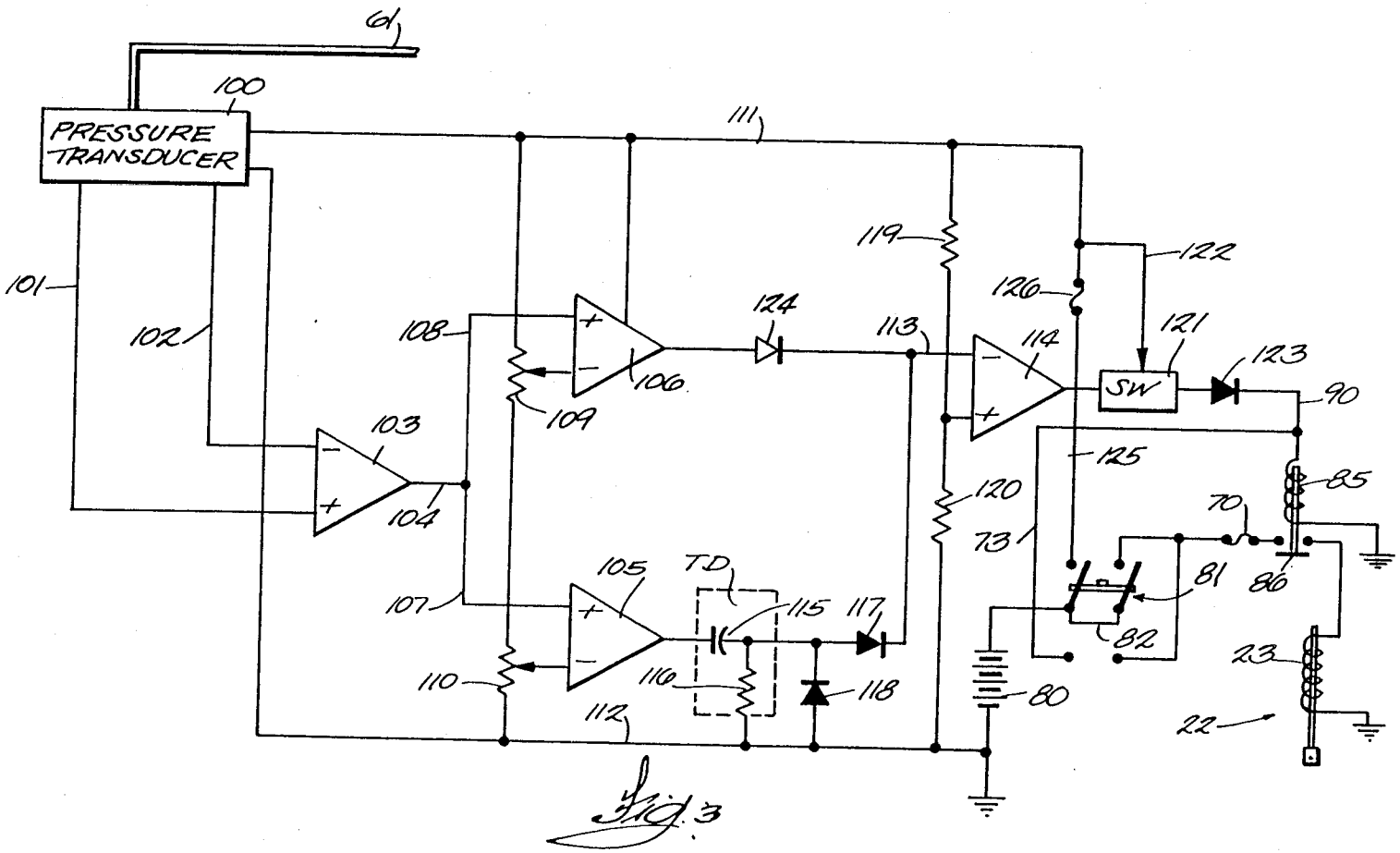
FIG. 3 is a schematic representation of an alternative embodiment of an engine throttle control wherein pressure is sensed with one transducer and switching is done electronically.

An alternative implementation of the inventive concepts will now be described in reference to FIG. 3. System components that perform the same function as in the FIG. 2 embodiment are given the same reference numerals. The FIG. 3 embodiment employs a pressure-to-signal transducer to perform the pressure sensing functions which were performed by pressure responsive switch means 64 and 67 in the previously described embodiment. Suitable pressure transducers are commercially available. The typical one employed in a commercial embodiment uses semiconductor strain gages, not shown, which are epoxy bonded to a metal diaphragm. Pressure applied to the diaphragm through a pressure port produces a small deflection which introduces strain to the gages. The strain produces an electrical resistance change proportional to the pressure and, hence, an electric signal whose amplitude changes with pressure. In FIG. 3, the fragmentarily shown pressure sensing line is marked 61 and corresponds to the same line in the FIG. 2 embodiment. Pressure transducer 100 has two output lines 101 and 102 that are input to an amplifier 103. Signal level on the output 104 of the amplifier changes in proportion to sensed pressure. Two amplifiers 105 and 106 are provided to perform switching functions. The output signal from amplifier 104 is provided by way of lines 107 and 108 and one input of operational amplifiers 105 and 106, respectively. Two potentiometers 109 and 110 are connected in series between a voltage supply line 111 and a line 112 which is at ground potential. The voltage is supplied from the vehicle battery 80. Amplifier 105 is biased by potentiometer 110 to turn on or produce an output signal when the signal on its non-inverting input 107 rises above a level that corresponds to pressure transducer 100 sensing an increase in pressure in line 61 to above 300 psi, for example. In a practical embodiment, potentiometer 110 is adjustable to cause amplifier 105 to switch to a conductive state in a range of 225 to 325 psi. Potentiometer 109 associated with the higher pressure switching means 106 might be adjusted so that amplifier 106 switches and produces an output signal when the pressure transducer senses pressure in line 61 in excess of 700 psi. In a practical embodiment, the range allowed for by adjusting potentiometer 109 is 600 to 700 psi. When a control valve such as valve 34 or 48, shown in the FIG. 2 embodiment, is actuated, pressure on line 61 in FIG. 3 increases immediately as does the output signal from amplifier 103. The first switching means, namely amplifier 105 turns on and produces an output signal immediately. This results in throttle control relay 23 being energized so the throttle 21 opens and the engine goes up to its higher speed. This results in a pressure increase to about 700 psi in this example in which case the signal on input 108 to amplifier 106 increases and this amplifier turns on.

The output signal from low threshold pressure switching means or amplifier 105 is coupled to the inverting input 113 of an operational amplifier 114 through a circuit that includes a capacitor 115, a resistor 116 and diodes 117 and 118. Output amplifier 114 is biased with a voltage divider including series connected resistors 119 and 120. For the moment assume that a low pressure threshold has been reached due to actuation of a control valve. The output signal which is then coupled from the output of switching amplifier 105 to the input 113 of amplifier 114 results in an output signal from the latter which turns on a transistor switch (SW) which is represented by the block marked 121. Transistor switch 121 then turns on and power is supplied from line 111 through line 122 to the transistor switch whose output is through a diode 123 to relay coil 85. This results in closure of relay contact 86 and concurrent energization of throttle control relay 23. The engine thereby switches to its higher speed for actuating the hydraulic control devices.

As the engine is increasing speed, pressure in line 61 increases as does the input signal to switching amplifier 106. This amplifier then turns on, at about 700 psi in this example, and provides a signal through a diode 124 to input 113 of amplifier 114. The output of amplifier 114 thereby maintains the transistor switch 121 in its conductive state so that relays 85 and 23 continue to be energized as long as the high pressure resulting from actuation of a hydraulic control valve persists.

The circuit is energized from vehicle battery as in the previously described embodiment through a double-throw double-pole switch 81. When the switch is closed to its upper contacts as shown, power supplied through its left upper contact through a line 125 and a fuse 126 to the electronic circuit supply line 111. The upper right contact of switch 81 then supplies power through fuse 70 and contacts 86, which are closed when relay 85 is energized, to throttle control solenoid 23. As in the previously described embodiment, when it is desired to set the engine at its higher speed, switch 81 is transferred to connect battery 80 to its lower contacts. In such case, power is aupplied by way of line 73 to relay 85 so its contacts 86 close to energize throttle control solenoid 23 from the lower right contact of switch 81.

When low pressure threshold responsive amplifier 105 switches to its conductive state in correspondence with an increase in pressure in sensing line 61, this amplifier delivers an output signal through capacitor 115 to output amplifier 114. The capacitor and resistor 116 serve as a differentiator so output amplifier 114 switches to its conductive state quickly after low threshold pressure is sensed. The capacitor remains charged as long as the input signal to switching amplifier 105 remains above low threshold level. Thus, capacitor 115 cannot couple a signal from switching amplifier 105 to output amplifier 114 during this time. When a manually controlled valve is returned to neutral position and pressure drops below 700 psi in line 61, the second switching amplifier 106 turns off immediately and deenergizes relays 85 and 23 so engine speed drops toward idle speed immediately. As previously indicated, however, a short time elapses before hydraulic pressure drops below 300 psi in this example. During the short time amplifier 105 would continue to receive an actuating signal from pressure transducer 100 which would tend to cause switching amplifier 105 to produce an output signal that would maintain energization of relay coils 85 and 23 but no such energizing signal can get through until capacitor 115 discharges through the circuit including resistor 116 and the amplifier. The time required for the pressure to drop from the high level to the low level following control valve deactivation depends on the characteristics of the particular hydraulic system with which the control is associated. The time delay necessary for the pressure to drop to the low level is determined by the value of resistor 116 or capacitor 115 in the time delay circuit which is labeled TD in FIG. 3.

In summary, it will be seen that the FIG. 3 embodiment is comparable in principle to the FIG. 2 embodiment in that, in both cases, there are means that provide indications of two different pressure levels and switching means that respond to the levels by switching the engine to high speed when hydraulic pressure increases and to low or idle speed immediately after pressure drops to below a predetermined high level.

It should be understood that where numerical values are used in the foregoing specification to indicate pressures and engine speeds that they are not intended to be restricted to those values only but are used to obtain the improved clarity that results from using concrete values rather than relative terms exclusively.

Although illustrative embodiments of the new electro-hydraulic engine throttle control has been described in detail, such description is intended to be illustrative rather than limiting, for the invention may be variously embodied and is to be limited only by interpretation of the claims which follow.

I claim:

1. In apparatus including an internal combustion engine having a throttle settable to control its speed, a pump driven by the engine, a hydraulic actuator operable by pressurized fluid from the pump, control valve means having an inlet and an outlet and means for bypassing fluid from the inlet to the outlet, an electric power source, means coupling the outlet of the pump to the inlet of the valve and means coupling the outlet of the valve to the actuator, and an improved system for setting the throttle to obtain alternate engine speeds, comprising:

electroresponsive means operatively coupled to the throttle and when inactivated setting the throttle for the engine to run at idle speed and for the pump to produce a lower pressure and when activated setting the throttle for the engine to run at higher speed and for the pump to produce a higher pressure, a switching device controllable to connect and disconnect the electroresponsive means to and from said power source for respectively activating and inactivating said means, first and second pressure responsive means responsive to low and higher fluid pressure levels between the outlet of the pump and the inlet to said control valve and first and second switches controlled, respectively, by said pressure responsive means, time delay means and an associated switch that is in a circuit with said first switch and said switching device and is controlled by said time delay means, the first pressure responsive means responding to a pressure increase above a lower level, that results from operating said valve and closing said bypass, by closing said first switch to thereby control said switching device, when the time delay switch is also closed to connect said electroresponsive means to said power source to thereby activate said means and actuate the throttle and cause the engine to change from idle speed to a higher speed accompanied by higher pump output pressure, said time delay means responding to closing of said first switch by initiating a timing interval and by opening its associated switch at the end of the interval, the second pressure responsive means responding to the higher pressure by closing said second switch for controlling said switching device to maintain the connection of the electroresponsive means to the power source, said second pressure responsive means responding to a drop in pressure, caused by said control valve being operated to restore said bypass, by opening said second switch means to cause deactivation of said electroresponsive means, said first pressure responsive means responding to the pressure dropping to about said low pressure level by opening the first switch, and said time delay means responding to said first switch opening by reclosing its switch to thereby reset the system for another operational cycle.

2. The system as in claim 1 wherein said switching device for connecting said electroresponsive means to the power source is a relay including an operating coil and contacts controlled thereby, said coil being energizable through the circuit including said first switch and the switch of the time delay means when there is a pressure increase resulting from operating said valve, and said coil causing said contacts to close to effect connection of said electroresonsive means to said electric power source, said coil also being energizable through the circuit including said second switch to maintain said connection of the electric power source to the electroresponsive means.

3. The system as in claim 1 wherein said engine idle speed is about 600 rpm.

4. The system as in claim 1 wherein said first pressure responsive means is set to cause said first switch to close at a pressure slightly exceeding a preset pressure in a range of 225 to 325 psi and to open at a pressure slightly below the preset pressure.

5. The system as in claim 1 wherein said second pressure responsive means is set to cause said second switch to close at a pressure slightly exceeding a preset pressure in a range of 600 to 700 psi and to open at a pressure slightly below the preset pressure.

6. In apparatus including an internal combustion engine having a throttle settable to control its speed, a pump driven by the engine, a hydraulic actuator operable by pressurized fluid from the pump, control valve means having an inlet and an outlet and means for bypassing fluid from the inlet to the outlet, an electric power source, means coupling the outlet of the pump to the inlet of the valve and means coupling the outlet of the valve to the actuator, and an improved system for setting the throttle to obtain alternate engine speeds, comprising:

electroresponsive means including an operating coil and an armature operatively coupled to the throttle, deenergization of the coil permitting said engine to run at idle speed and the pump to produce a lower pressure and energization of said coil causing the engine to run at a higher speed and the pump to produce a higher pressure, a switching device responsive to being energized and deenergized by connecting and disconnecting said operating coil to and from said electric power source, one circuit and an alternate circuit connected between said electric power source and said switching device, a first switch and another switch connected in series in one of said circuits and a second switch in the alternate circuit, first and second pressure responsive means responsive to low and higher pressure levels between the outlet of the pump and the inlet of the control valve and respectively controlling said first and second switches, a time delay device for controlling said another switch in the one of said circuits, said device responding to closing of said first switch by initiating a timing interval and by opening said another switch at the end of said interval, the first pressure responsive means responding to a pressure increase above said low level, that results from actuating said valve and closing said bypass, by closing said first switch to energize said switching device during said interval and cause operation of said throttle for the engine to change from idle speed to a higher speed accompanied by higher pump output pressure, said second pressure responsive means responding to the higher pressure by closing said second switch to energize said switching device through said alternate circuit and to maintain such energization after said other switch opens at the end of the time interval, said second pressure responsive means responding to a drop in pressure, caused by said control valve being operated to restore said bypass, by opening the second switch to thereby deenergize said switching device, said first pressure responsive means responding to said pressure dropping to about said lower pressure level by opening said first switch, and said time delay device responding to said first switch opening by reclosing its switch to thereby reset the system for another operational cycle.

7. The system as in claim 6 including means for overriding automatic control of the engine by said system including:

a circuit including a manually operable switch and a conductor for connecting said electric power source directly to said switching device to thereby energize said device and cause the engine to run at said higher speed, one diode having its anode connected to said other switch in the one circuit that is controlled by the time delay device and its cathode connected to said switching device, another diode having its anode connected to said second switch controlled by the second pressure responsive means and its cathode connected to said switching device, said diodes preventing feedback into said one and said alternate circuits.

8. The system as in claim 6 wherein said switching device for connecting said electroresponsive means to the power source is a relay including an operating coil and contacts controlled thereby, said coil being energizeable through the circuit including said first switch and the switch of the time delay means when there is a pressure increase resulting from operating said valve, and said coil causing said contacts to close to effect connection of said electroresponsive means to said electric power source, said coil also being energizeable through the circuit including said second switch to maintain said connection of the electric power source to the electroresponsive means.

9. The system as in claim 6 wherein said engine idle speed is about 600 rpm.

10. The system as in claim 6 wherein said first pressure responsive means is set to cause said first switch to close at a pressure slightly exceeding a preset pressure in a range of 225 to 325 psi and to open at a pressure slightly below said preset pressure.

11. The system as in claim 6 wherein said second pressure responsive means is set to cause said second switch to close at a pressure slightly exceeding a preset pressure in a range of 600 to 700 psi and to open at a pressure slightly below said preset pressure.

12. In apparatus including an internal combustion engine having a throttle settable to control its speed, a pump driven by the engine, a hydraulic actuator operable by pressurized fluid from the pump, control valve means having an inlet coupled to the outlet of the pump and an outlet coupled to the hydraulic actuator and means for bypassing fluid from the inlet to the outlet, an electric power source, means coupling the outlet of the pump to the inlet of the valve and means coupling the outlet of the valve to the actuator, and an improved system for setting the throttle to obtain alternate engine speeds, comprising:

electroresponsive means operatively coupled to the throttle for setting the throttle so the engine runs at idle speed and the pump produces relatively lower pressure and said means being operative to set the throttle so the engine runs at higher speed and the pump produces relatively higher pressure;

sensing means for sensing the pressure between the outlet of the pump and the inlet of said control valve;

first switch means responding to a pressure increase above a predetermined lower level being sensed, as a result of opening said control valve to provide pressurized fluid to said actuator and concurrently closing said bypass by operating said electroresponsive means with electric power from said source to thereby set said throttle for the engine to run at a higher speed and for the pump to produce higher pressure;

second switch means responsive to said higher pressure being sensed by maintaining operation of said electroresponsive means with power from said source;

said second switch means responding to a pressure drop below said higher pressure as a result of closing said valve and opening said bypass by terminating operation of said electroresponsive means; and time delay means operative to disable said first switch means from operating said electroresponsive means until the pressure has dropped below said lower pressure level after said valve is closed and said bypass is opened again.

13. The system according to claim 12 wherein said means for sensing pressure comprises a transducer operative to convert pressure to a signal proportional to pressure, said first switch means includes a first amplifier having an output and one input for said signal proportional to pressure and another input for a first reference signal, said second switch means includes a second amplifier having an output and one input for said signal proportional to pressure and another input for a second different reference signal, a third amplifier having an output and an input for a third reference signal and another input, means for coupling the outputs of said first and second amplifiers to said another input of said third amplifier, and switch means operative in response to the output signal of said third amplifier by coupling and uncoupling said electroresponsive means to and from said power source, said first amplifier responding to a signal from said transducer as pressure rises corresponding to said lower pressure level and greater than said first reference signal by providing a signal to said another input of said third amplifier for operating said last named switch means to couple said electroresponsive means to said power source, said second amplifier responding to a signal from said signal as pressure rises further to said higher pressure and higher than said second reference signal by providing the signal to said another input of said third amplifier for operating said last named switch means to couple said electroresponsive means to said power source.

14. In apparatus including an internal combustion engine having a throttle settable to control its speed, a pump driven by the engine, a hydraulic actuator operable by pressurized fluid from the pump, control valve means having an inlet coupled to the outlet of the pump and an outlet coupled to the hydraulic actuator and means for bypassing fluid from the inlet to the outlet, an electric power source, means coupling the outlet of the pump to the inlet of the valve and means coupling the outlet of the valve to the actuator, and an improved system for setting the throttle to obtain alternate engine speeds, comprising:

transducer means operative to produce an electric signal proportional to the pressure between the outlet of the pump and the inlet of said control valve, electroresponsive means operatively coupled to the throttle, said means when deenergized setting said throttle so the engine runs at idle speed and the pump produces relatively low pressure and when energized setting said throttle so the engine runs at higher speed and the pump produces higher pressure, control switch means for coupling and uncoupling said electroresponsive means, respectively, to and from said electric power source, first switch means operative in response to an increase in said signal resulting from the pressure increase above a predetermined lower level caused by opening said control valve and closing said bypass to supply pressurized fluid to said actuator by causing said control switch means to couple said electroresponsive means to set said throttle for the engine to run at higher speed and the pump to produce higher pressure, second switch means operative in response to said higher pressure occurring by causing said control switch means to maintain said coupling of the electroresponsive means to the source, said second switch means responding to occurrence of a pressure drop below said higher pressure resulting from closing said valve and opening said bypass by uncoupling said electroresponsive means from said power source, and time delay means operative to prevent said first switch means from causing said control switch means to couple said electroresponsive means to said source again until said pressure has dropped below said lower pressure level following closing said valve and opening said bypass.

* * * * *